US008037720B2

(12) United States Patent
Hellhake et al.

(10) Patent No.: US 8,037,720 B2
(45) Date of Patent: Oct. 18, 2011

(54) WASHING MACHINE WITH LAUNDRY-DETERGENT DRAWER HAVING MEANS TO ASSIST AN OPENING OR CLOSING MOVEMENT

(75) Inventors: Wolfgang Hellhake, Lippstadt (DE); Robert Muether, Rheda-Wiedenbrueck (DE)

(73) Assignee: Miele & Cie. KG, Guetersloh (DE)

( * ) Notice: Subject to any disclaimer, the term of this patent is extended or adjusted under 35 U.S.C. 154(b) by 882 days.

(21) Appl. No.: 11/464,713

(22) Filed: Aug. 15, 2006

(65) Prior Publication Data

US 2007/0037730 A1 Feb. 15, 2007

(30) Foreign Application Priority Data

Aug. 15, 2005 (DE) ..... 10 2005 038 727

(51) Int. Cl.
*D06F 39/02* (2006.01)

(52) U.S. Cl. ..... 68/17 R; 312/319.1; 312/330.1

(58) Field of Classification Search ..... 68/17 R
See application file for complete search history.

(56) References Cited

U.S. PATENT DOCUMENTS

| | | | | |
|---|---|---|---|---|
| 4,828,344 | A | 5/1989 | Omata et al. | |
| 5,675,994 | A | 10/1997 | Gweon et al. | |
| 6,848,759 | B2 * | 2/2005 | Doornbos et al. | 312/319.1 |
| 6,865,911 | B2 * | 3/2005 | Bolduan et al. | 68/17 R |

FOREIGN PATENT DOCUMENTS

| | | | |
|---|---|---|---|
| DE | 39 24 586 | C2 | 7/1998 |
| DE | 103 55 671 | A1 | 6/2004 |
| EP | 1 403 415 | A2 | 3/2004 |
| JP | 2003-004078 | * | 6/2001 |
| JP | 2003-040023 | * | 7/2001 |

OTHER PUBLICATIONS

Partial Machine translations of Otake reference and Masuzawa reference.*

* cited by examiner

*Primary Examiner* — Michael Barr
*Assistant Examiner* — Jason Riggleman
(74) *Attorney, Agent, or Firm* — Leydig, Voit & Mayer, Ltd.

(57) ABSTRACT

A washing machine includes a laundry-detergent and fabric-softener drawer that can be pulled out of the machine. A movement assist device is provided that cooperates with the drawer so as to assist an opening and/or closing movement of the drawer. The movement assist device includes a scroll spring for causing a restoring force for an autonomous closing procedure of the drawer.

6 Claims, 5 Drawing Sheets

WASHING MACHINE WITH LAUNDRY-DETERGENT DRAWER HAVING MEANS TO ASSIST AN OPENING OR CLOSING MOVEMENT

Priority is claimed to German patent application DE 10 2005 038 727.6, filed Aug. 15, 2005, the entire subject matter of which is hereby incorporated by reference herein.

The invention relates to a washing machine with a laundry-detergent and fabric-softener drawer that can be pulled especially out of the front of the machine and that cooperates with means to assist the opening and/or closing movement of the drawer.

BACKGROUND

The state of the art describes laundry-detergent and fabric-softener drawers that cooperate especially with so-called mechanisms that assist the opening and closing movement of the drawer. Thus, for example, German patent DE 39 24 586 C2 discloses a washing machine having a movable laundry-detergent tray that has an electromagnetically actuatable drive means. Here, the drawer cooperates with a toothed rack which, in turn, engages with a toothed wheel that is driven by an electric motor. In this manner, the drawer is opened and closed by means of a control button in the front of the machine housing. A device of this kind is also known from German patent application DE 103 55 671 A1 as well as from European patent application EP 1 403 415 A2.

A drawback of these embodiments known from the state of the art is considered to be the fact that the production of the drawer is cost-intensive since it involves the additional motor with gears, which also calls for additional wiring, especially since more assembly work is required, whereby the laundry-detergent and fabric-softener drawer can only be operated when the washing machine is electrically connected.

U.S. Pat. No. 4,828,344 describes a furniture drawer that cooperates with assisting means for the opening and closing movement. A gear is used as the assisting means, comprising a toothed wheel that is mounted in the shaft and that cooperates with a toothed rack on the drawer. The toothed rack is made to rotate by means of a spiral spring, the teeth of the toothed wheel engaging in the teeth of the toothed rack on the drawer, thereby converting the rotation of the toothed wheel into a linear sliding movement. The spiral spring is completely wound up and secured when the drawer is pushed into the accommodation shaft. The spring is released by pushing on the drawer. When the spring is unwound, the toothed wheel is made to rotate, as a result of which the drawer is moved out of the shaft. However, the proper functioning of the gear requires that, if at all possible, no dirt should get into the teeth, since this could hamper or prevent the movement.

SUMMARY

It is therefore an object of the present invention to provide a washing machine with a laundry-detergent and fabric-softener drawer that can be pulled especially out of the front of the machine, which is cost-effective to produce and which fulfills the prerequisites of user-friendliness and functional reliability.

In an embodiment, the present invention provides a washing machine including a laundry-detergent and fabric-softener drawer configured to be pulled out of the machine. A movement assist device is included that is configured to cooperate with the drawer so as to assist at least one of an opening and a closing movement of the drawer. The movement assist device includes a scroll spring configured to cause a restoring force for an autonomous closing procedure of the drawer.

BRIEF DESCRIPTION OF THE DRAWINGS

An embodiment of the present invention is shown schematically in the drawings and is described in greater detail below. The following are shown.

DETAILED DESCRIPTION

An advantages of the present invention is that the assisting means according to the invention does not require special components such as gears, motors or operating elements on the front of the machine. The retraction aid is based on simple mechanical means that enables its user-friendliness and functional reliability. For this purpose, the assisting means comprises a scroll spring that brings about a restoring force for the autonomous closing procedure of the drawer, especially in the unrolled state when the drawer is pulled out. In an advantageous manner, the restoring force is provided by a scroll spring that accumulates the force so that, once the drawer has been unlatched, it retracts autonomously.

Especially in order to ensure a controlled retraction procedure, the scroll spring cooperates with a damping device that acts against the restoring force. The damping device here is arranged coaxially on the drum axis for the scroll spring. In embodiment of the invention, the damping device comprises a blade wheel that rotates along with the drum and that is operatively connected to a viscous, preferably highly viscous, compound or fluid. In an embodiment of the invention, the individual blades of the blade wheel are oriented radially with a tangential preferential direction so that the damping in the manually actuated pull-out direction is less than in the spring-actuated retraction direction or is almost without effect. Consequently, the drawer is easy to pull out, even against the spring force.

In an embodiment, the drawer cooperates with a carriage that, in turn, is connected to the drawer via a latching connection. Due to this configuration, it is achieved that the drawer can be separated from the carriage in order to take it out of the drawer compartment for cleaning purposes. Here, the drawer in the pulled-out state is in a parked position in which it is held by means of latching bevels.

Figure 5:
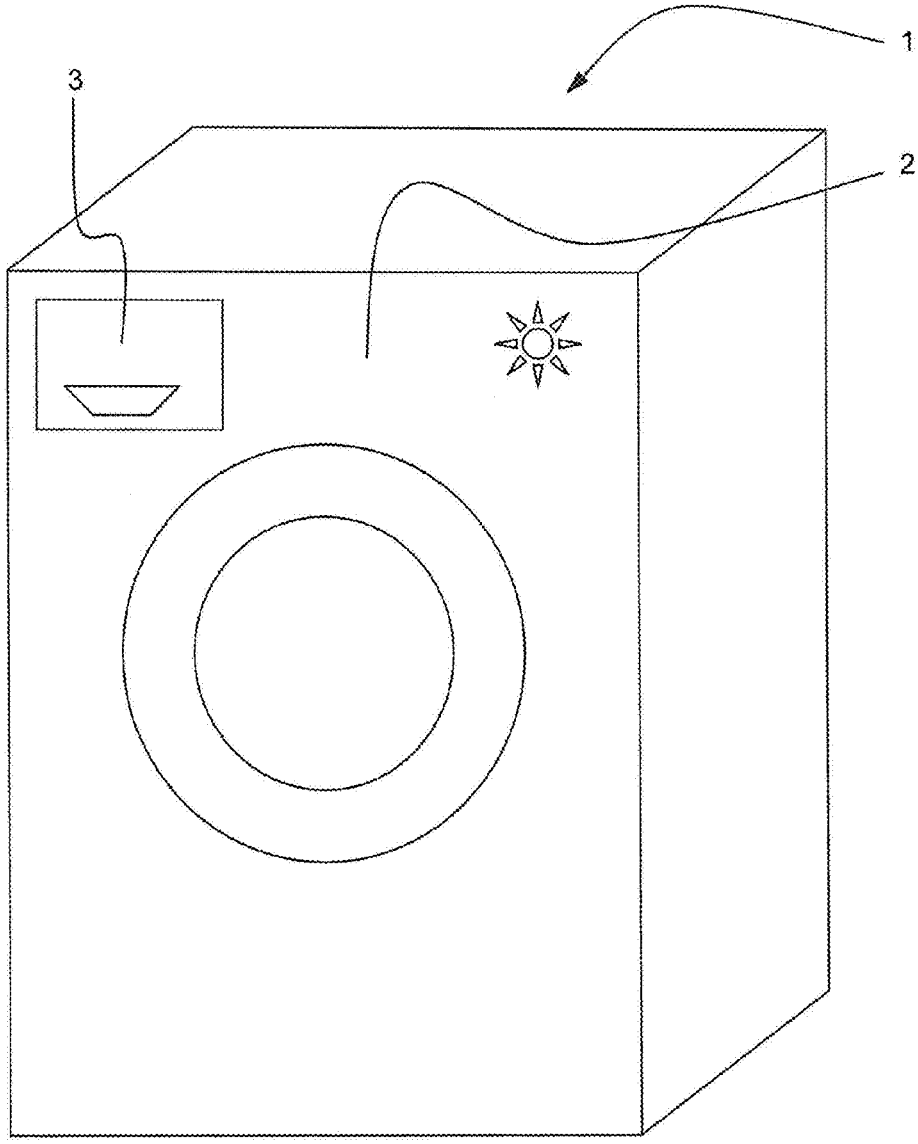
FIG. 5: a diagram of the washing machine.

FIG. 5 shows a diagram of a washing machine in a front view. The washing machine comprises a housing 1 with a front 2. A laundry-detergent and fabric-softener drawer 3 is inserted into the housing 1 and said drawer 3 can be opened and closed from the front 2.

Figure 1:
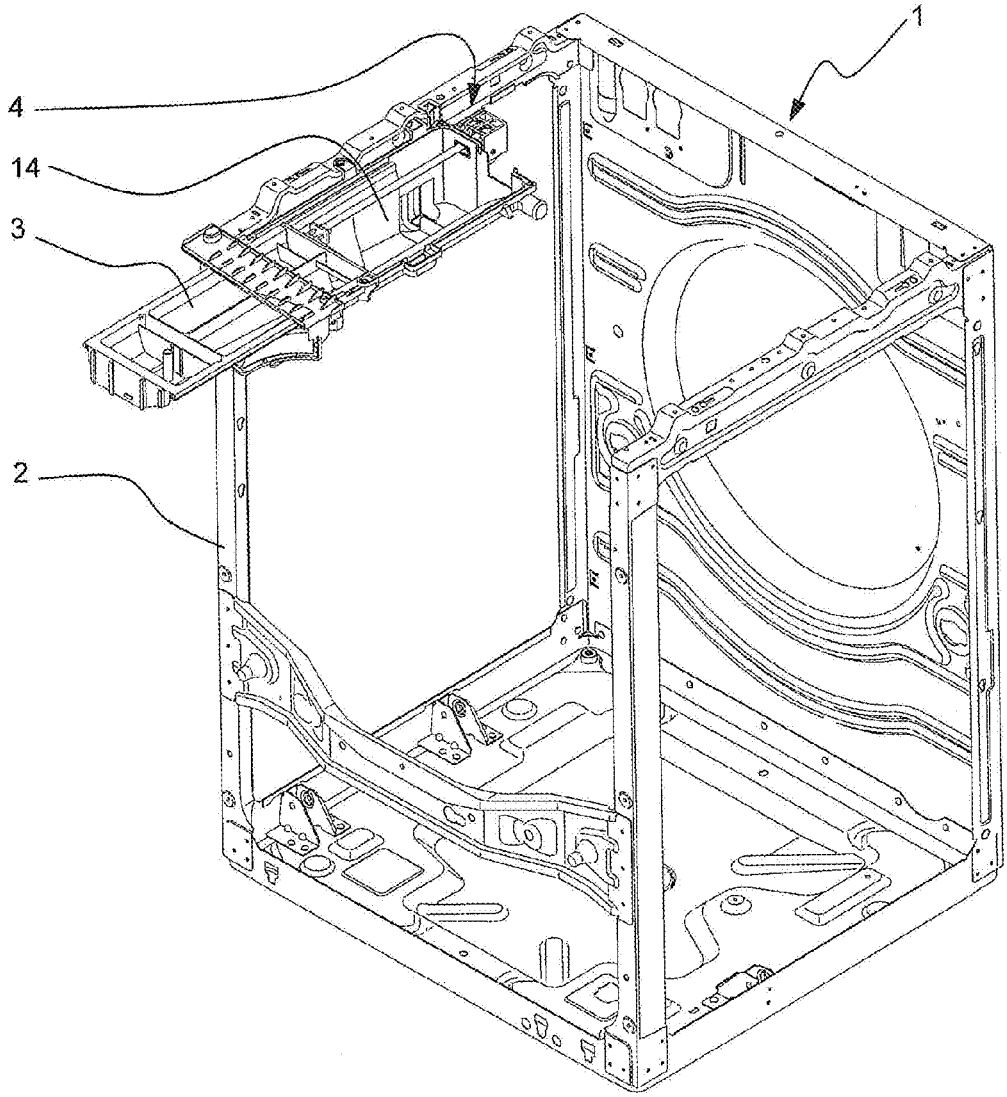
FIG. 1: a laundry-detergent and fabric-softener drawer in a perspective view, integrated into a machine housing of a washing machine.
Figure 2:
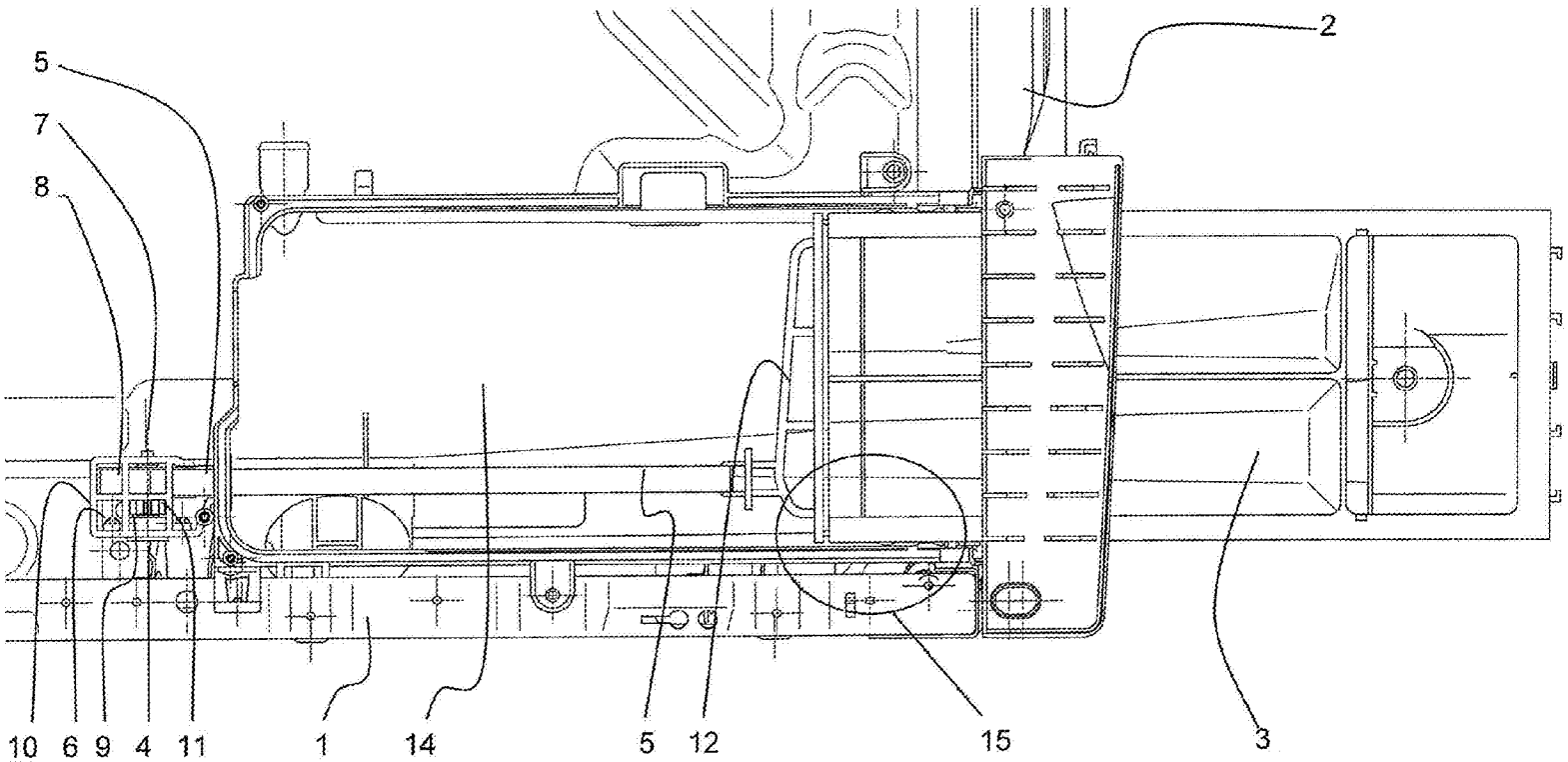
FIG. 2: a top view of the laundry-detergent and fabric-softener drawer in the partially pulled-out state.
Figure 3:
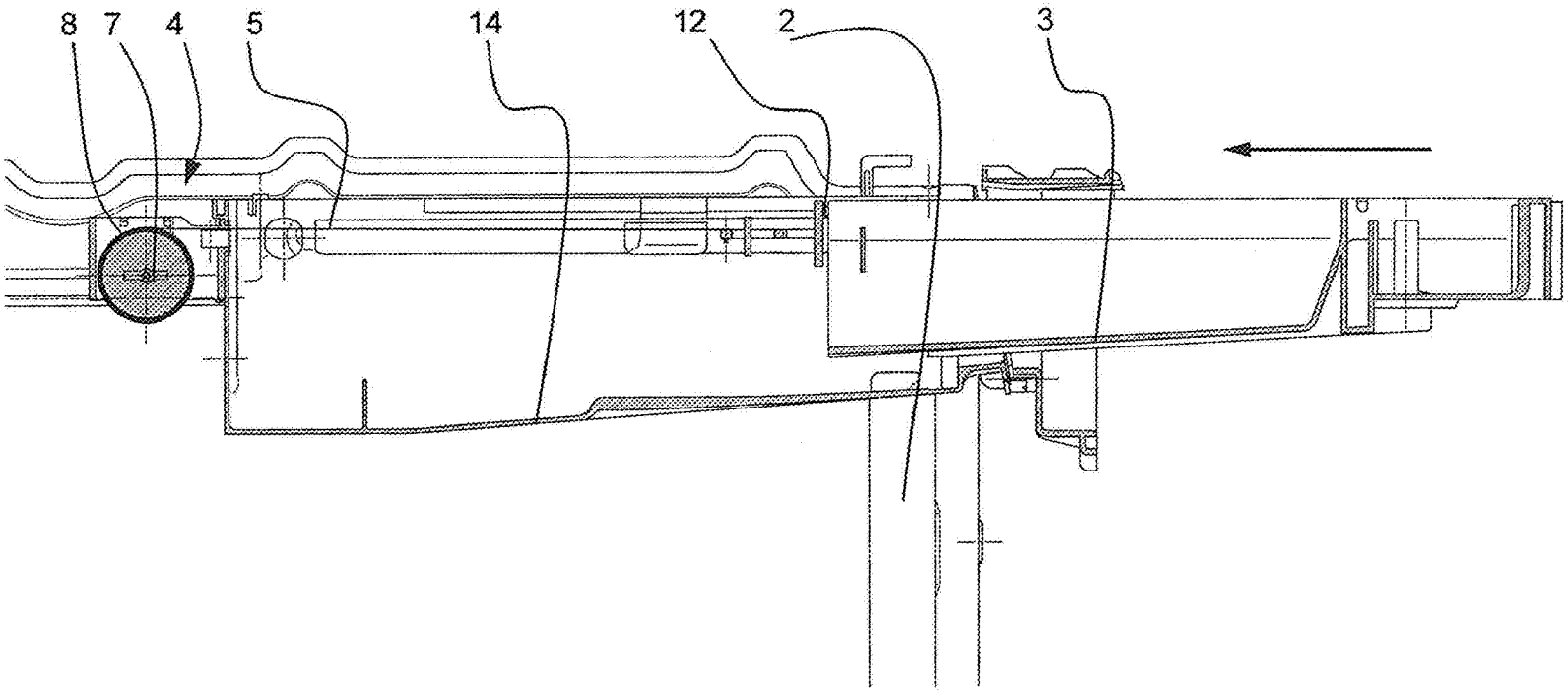
FIG. 3: a cutaway side view of the laundry-detergent and fabric-softener drawer in the pulled-out state.

FIG. 1 shows a perspective view of a housing 1 of a washing machine with a laundry-detergent and fabric-softener drawer 3 that can be pulled especially out of the front 2 of the machine and that cooperates with means 4 that assist the opening or closing movement of the drawer. As can be seen in FIGS. 2 and 3, the assisting means 4 comprises a scroll spring 5 that, in the unrolled state, as can be seen especially in FIG. 3, that is to say, when the drawer 3 is pulled out, brings about a restoring force for the autonomous closing of the drawer 3. A steel strip or a plastic strip can be used as the scroll spring 5, said strip having an intrinsic tension that, in the relaxed state, causes it to roll up.

The scroll spring 5 cooperates here with a damping device 6 that acts against the restoring force, as can be seen in more detail in FIG. 2. The damping device 6 here is arranged coaxially on the drum axis 7 for the scroll spring 5. As can be seen in FIG. 2, the damping device 6 comprises a blade wheel 9 that rotates along with the drum 8 or is affixed to it non-rotatably and that is operatively connected to a viscous compound or fluid that is accommodated in the blade wheel housing 10. Here, the individual blades 11 of the blade wheel 9 are oriented radially with a tangential preferential direction so that the damping in the manually actuated pull-out direction is less than in the spring-actuated retraction direction, as shown by the directional arrow in FIG. 3. Tangential mobility or deflection of the individual blades 11 is likewise possible so that, in the manually actuated pull-out direction, the blades 11 are moved with less flow resistance through the viscous compound or fluid.

Figure 4:
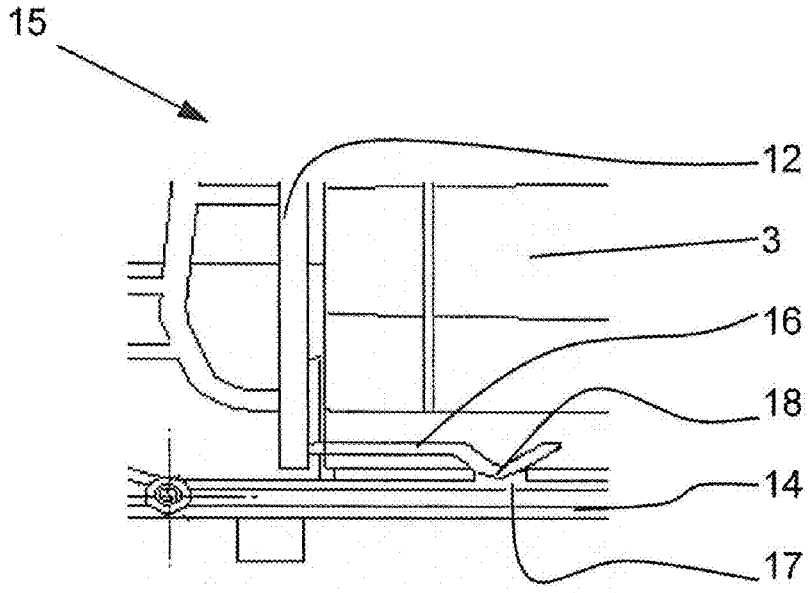
FIG. 4: a detailed view of the latching connection between the carriage and the drawer

As can be seen in greater detail in FIGS. 2 and 4, the drawer 3 cooperates with a carriage 12, said carriage 12 being connected to the drawer 3 via a latching connection. In particular, the latching connection makes it possible to separate the drawer 3 from the carriage 12 in order to clean the drawer 3. For purposes of ensuring that the drawer 3 remains in a parked position when in the pulled-out state, the drawer 3 is mounted on the machine housing 1 by means of a latching catch 18 that latches behind a latching edge in the accommodation shaft 14. The latching catch 18 can be seen in greater detail in FIG. 4.

As can also be seen in FIG. 2, the drawer 3 as well as the carriage 12 are configured so that they can slide in the accommodation shaft 14.

As can be seen by considering the figures together, a kinematic mechanism is flanged onto the accommodation shaft 14 and it is tensioned by pulling out the drawer 3. The drawer 3 is connected to this kinematic mechanism via a latched carriage 12. The section 15 is shown in FIG. 4 as a detailed view of the latching connection between the carriage 12 and the drawer 3. A web 16 facing the drawer 3 is attached to or integrally formed onto the carriage 12 on each of the lateral edges and the outer end of the web 16 has a latching catch 18 with two lifting bevels. This web 16 is arranged so as to be intrinsically springy in the horizontal direction crosswise to the sliding direction and thus acts in some areas like a leaf spring. Each of the side walls of the drawer 3 contains an opening 17 into which the latching catch 18 latches when in the attached state.

FIG. 3 illustrates how, in an end position, the drawer 3 is secured in a parked position by means of the latching catch 18 after being pulled out in order to be filled. By lifting the drawer 3 out of the parked position, it is pulled back into the accommodation shaft 14 by means of the tensioned kinematic mechanism. The uniform damping that is integrated into the kinematic mechanism ensures a linear retraction speed. In order to clean the drawer 3, the latter is pulled out beyond the parked position and then separated from the carriage 12 via two lateral cams. The carriage 12 retracts autonomously in a damped manner. In order to engage the drawer 3, it is slid into the end position of the accommodation shaft 14, where it latches of its own accord into the carriage 12.

What is claimed is:

1. A washing machine comprising:

a laundry-detergent and fabric-softener drawer configured to be pulled out of the machine;

a slidable carriage connected to the drawer via a latching connection such that the drawer is separable from the carriage, wherein the latching connection includes a latch bevel of the slidable carriage that is configured to hold the drawer and the slidable carriage in a pulled-out state in a parked position; and a movement assist device configured to cooperate with the drawer so as to assist at least one of an opening and a closing movement of the drawer, the movement assist device including a scroll spring connected to the drawer such that extension of the drawer extends the scroll spring into an unrolled state so as to tension the scroll spring and cause a restoring force for an autonomous closing procedure of the drawer.

2. The washing machine as recited in claim 1 wherein the drawer is configured to be pulled out of a front of the machine.

3. The washing machine as recited in claim 1 further comprising a damping device configured to cooperates with the scroll spring and to act against the restoring force.

4. The washing machine as recited in claim 3 wherein:

the scroll spring is disposed on a drum having a drum axis; and the damping device is disposed coaxially on the drum axis.

5. The washing machine as recited in claim 4 wherein the damping device includes a blade wheel configured to rotate along with the dram and is operatively connected to a viscous compound or fluid.

6. The washing machine as recited in claim 5 wherein individual blades of the blade wheel are oriented radially with a tangential preferential direction so as to provide a damping in a manually actuated pull-out direction that is less than a damping in a spring-actuated retraction direction.

* * * * *